US010377964B2

(12) United States Patent
Kimura et al.

(10) Patent No.: US 10,377,964 B2
(45) Date of Patent: Aug. 13, 2019

(54) MAGNETO-RHEOLOGICAL GREASE COMPOSITION

(71) Applicants: KYODO YUSHI CO., LTD., Fujisawa-shi, Kanagawa (JP); YOKOHAMA NATIONAL UNIVERSITY, Yokohama-shi, Kanagawa (JP)

(72) Inventors: Hiroshi Kimura, Fujisawa (JP); Shinya Kondo, Fujisawa (JP); Tetsuo Ogawa, Fujisawa (JP); Makoto Hayama, Fujisawa (JP); Koji Maesaka, Fujisawa (JP); Shin Morishita, Yokohama (JP); Ken Nakano, Yokohama (JP); Toshihiko Shiraishi, Yokohama (JP)

(73) Assignees: KYODO YUSHI CO., LTD., Fujisawa (JP); YOKOHAMA NATIONAL UNIVERSITY, Yokohama (JP)

( * ) Notice: Subject to any disclaimer, the term of this patent is extended or adjusted under 35 U.S.C. 154(b) by 739 days.

(21) Appl. No.: 13/679,568

(22) Filed: Nov. 16, 2012

(65) Prior Publication Data

US 2013/0123153 A1 May 16, 2013

(30) Foreign Application Priority Data

Nov. 16, 2011 (JP) ..... 2011-250547

(51) Int. Cl.
*C10M 173/02* (2006.01)
*C10M 169/06* (2006.01)

(52) U.S. Cl.
CPC ..... *C10M 169/06* (2013.01); *C10M 2201/06* (2013.01); *C10M 2203/1045* (2013.01); *C10M 2205/0285* (2013.01); *C10M 2207/0406* (2013.01); *C10M 2207/2805* (2013.01); *C10M 2215/064* (2013.01); *C10M 2215/1026* (2013.01); *C10N 2210/08* (2013.01); *C10N 2230/58* (2013.01); *C10N 2240/08* (2013.01); *C10N 2250/10* (2013.01)

(58) Field of Classification Search
CPC . C10M 125/04; C10M 115/08; C10M 107/24
USPC ..... 508/154, 528; 252/572
See application file for complete search history.

(56) References Cited

U.S. PATENT DOCUMENTS

| | | | | |
|---|---|---|---|---|
| 5,462,684 | A * | 10/1995 | Naka | C10M 169/02 508/485 |
| 5,840,666 | A * | 11/1998 | Yokouchi et al. | 508/291 |
| 6,245,253 | B1 * | 6/2001 | Grasshoff et al. | 252/62.52 |
| 6,547,986 | B1 | 4/2003 | Kintz et al. | |
| 2007/0099801 | A1 * | 5/2007 | Kakizaki et al. | 508/168 |
| 2009/0014681 | A1 * | 1/2009 | Iyengar et al. | 252/62.54 |

FOREIGN PATENT DOCUMENTS

| | | |
|---|---|---|
| JP | 3-106996 | 5/1991 |
| JP | 9-169989 | 6/1997 |
| JP | 2001-507388 | 6/2001 |
| JP | 2004-510020 | 4/2004 |
| JP | 2006-253239 | 9/2006 |

OTHER PUBLICATIONS

Office Action issued in Japanese Patent Application No. 2011-250547 dated Nov. 25, 2013.

* cited by examiner

*Primary Examiner* — Prem C Singh
*Assistant Examiner* — Francis C Campanell
(74) *Attorney, Agent, or Firm* — Nixon & Vanderhye P.C.

(57) ABSTRACT

The invention provides a magneto-rheological grease composition which contains (a) a base oil including at least 30% by mass of an ether type synthetic oil; (b) an aliphatic diurea thickener; and (c) magnetic particles in an amount of 45 to 95% by mass based on the total mass of the composition. The magneto-rheological grease composition can show superior thermal stability, dispersion stability and magneto-rheological properties.

11 Claims, No Drawings

MAGNETO-RHEOLOGICAL GREASE COMPOSITION

This application claims priority to JP Application No. 2011-250547, filed 16 Nov. 2011, the entire of which is hereby incorporated by reference.

TECHNICAL FIELD

The present invention relates to a magneto-rheological grease composition suitable for use in dampers for cars, suspensions, joints of nursing-care robots, equipment for rehabilitation, antiseismic devices, safety interlock mechanisms and the like.

BACKGROUND ART

The magneto-rheological fluid has the properties that the fluid viscosity changes from low to high levels along with the change of the applied magnetic field. By taking advantage of the above-mentioned properties, the viscosity of the magneto-rheological fluid can be freely changed to absorb the impact according to the strength of the impact force. The magneto-rheological fluid can absorb any impact generated in the three phases, i.e., a gas phase, liquid phase and solid phase. In the absence of magnetic field, the magneto-rheological fluid shows low viscosity and behaves like a flexible spring. When the magnetic field is applied, the magnetic force gradually increases the viscosity of the fluid as if the spring tends to be rigid.

The magneto-rheological fluid plays a role of something like spring or damper because of the action of absorbing impact, as mentioned above. In the apparatus required to have the impact-absorbing effect, the magneto-rheological fluid can contribute to absorption of the impact by changing the strength of the magnetic field applied to the fluid so as to adjust the viscosity of the fluid. In the apparatus performing rhythmic piston movements, the viscosity of the fluid can be changed according to the conditions, which makes it possible to modify the piston movement in a desired manner, i.e., intermit the movement for a short period or long period of time, and repeat the cycle of operation.

U.S. Pat. No. 6,547,986 discloses a magneto-rheological grease composition comprising magnetic-responsive particles, a carrier fluid and a thickening agent, where polyurea is shown as an example of the thickening agent. JP 2006-253239 A discloses a urea-based grease, in particular comprising an alkyl-substituted diphenyl ether and an urea compound; and a magneto-rheological fluid containing a dispersion medium and magnetic particles. However, the dispersion stability of the magnetic particles and the magneto-rheological properties are still insufficient, so that there is an increasing demand for further improvement.

SUMMARY OF INVENTION

Technical Problem

An object of the invention is to provide a magneto-rheological grease composition having improved thermal stability, dispersion stability and magneto-rheological properties of the composition.

Solution to Problem

The invention provides a grease compositions shown below:

1. A magneto-rheological grease composition comprising the following components (a) to (c):

(a) a base oil comprising at least 30% by mass of an ether type synthetic oil;

(b) an aliphatic diurea thickener; and (c) magnetic particles in an amount of 45 to 95% by mass based on the total mass of the composition.

2. The magneto-rheological grease composition as described in the above-mentioned item 1, wherein the aliphatic diurea thickener (b) is represented by formula (I):

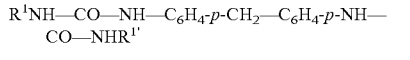

$$R^1NH—CO—NH—C_6H_4\text{-}p\text{-}CH_2—C_6H_4\text{-}p\text{-}NH—CO—NHR^{1'} \quad (1)$$

wherein $R^1$ and $R^{1'}$ are each independently a straight-chain or branched alkyl group having 6 to 20 carbon atoms.

3. The magneto-rheological grease composition as described in the above-mentioned item 1 or 2, wherein the ether type synthetic oil used in the base oil (a) is alkyldiphenyl ether oil.

4. The magneto-rheological grease composition as described in any one of the above-mentioned items 1 to 3, wherein the magnetic particles (c) are particles of at least one selected from the group consisting of iron and iron compounds.

5. The magneto-rheological grease composition as described in any one of the above-mentioned items 1 to 4, wherein the magnetic particles (c) have an average particle diameter of 0.1 to 10 μm.

6. The magneto-rheological grease composition as described in any one of the above-mentioned items 1 to 5, wherein the magnetic particles (c) are ferromagnetic particles.

7. The magneto-rheological grease composition as described in the above-mentioned item 6, wherein the ferromagnetic particles (c) are iron particles.

8. The magneto-rheological grease composition as described in any one of the above-mentioned items 1 to 7, further comprising an antioxidant (d).

9. The magneto-rheological grease composition as described in the above-mentioned item 8, wherein the antioxidant (d) is an amine type antioxidant.

10. The magneto-rheological grease composition as described in the above-mentioned item 9, wherein the amine type antioxidant (d) is alkyl diphenylamine and/or α-naphthylamine.

11. The magneto-rheological grease composition as described in any one of the above-mentioned items 1 to 10, having a worked penetration of 250 to 450.

12. An apparatus where the grease composition as described in any one of the above-mentioned items 1 to 11 is enclosed in a repeatedly moving part.

Effects of Invention

The invention can provide a magneto-rheological grease composition having excellent thermal stability, dispersion stability and magneto-rheological properties.

DESCRIPTION OF EMBODIMENTS

[(a) Base Oil]

The base oil used in the invention comprises at least 30% by mass of ether type synthetic oil. Examples of the ether type synthetic oil include alkyldiphenyl ether oils, polypropylene glycol oils, perfluoroalkyl ether oils and the like. In particular, alkyldiphenyl ether oils are preferable.

As the base oil, the above-mentioned ether type synthetic oil may be used alone, or in combination with other base oil components. The base oil components used in combination with the ether type synthetic oil are not particularly limited, but specifically include paraffinic mineral oils; naphthenic mineral oils; ester type synthetic oils such as diesters including dioctyl sebacate and the like, and polyol esters; synthetic hydrocarbon oils including poly α-olefin and polybutene; silicone oils; fluorinated oils and the like.

When other base oil components than the ether type synthetic oil are added, the content of the ether type synthetic oil is at least 30% by mass, preferably at least 50% by mass, based on the total mass of the base oil. Most preferably, the base oil may be made of 100% by mass of the ether type synthetic oil.

The base oil used in the invention may preferably have a kinetic viscosity at 40° C. of 60 to 140 $mm^2/s$, more preferably 80 to 120 $mm^2/s$. When the kinetic viscosity is too low, a satisfactory oil film cannot be formed, with the result that the fatigue life may be adversely affected. Excessively high kinetic viscosity may have an adverse effect on the low temperature properties.

The base oil may be contained in an amount of 3 to 50% by mass, preferably 5 to 25% by mass, more preferably 10 to 30% by mass, and further more preferably 10 to 25% by mass, in the composition of the invention.

[(b) Thickener]

The thickener used in the present invention is an aliphatic diurea thickener, preferably represented by the following formula (I):

$$R^1NH—CO—NH—C_6H_4\text{-}p\text{-}CH_2—C_6H_4\text{-}p\text{-}NH—CO—NHR^{1'} \quad (1)$$

wherein $R^1$ and $R^{1'}$ may be the same or different and are each independently a straight-chain or branched, preferably a straight-chain alkyl group, having 6 to 20 carbon atoms, preferably 8 to 20 carbon atoms, and more preferably 8 to 18 carbon atoms. Preferably, $R^1$ and $R^{1'}$ may be identical.

The aliphatic diurea thickener compounds can be obtained by a reaction of diphenylmethane-4,4'-diisocyanate with an aliphatic monoamine. Specific examples of the aliphatic monoamine include octylamine, dodecylamine, hexadecylamine, octadecylamine, oleylamine, and mixtures thereof. Of the above, octylamine, dodecylamine and hexadecylamine are more preferable, and octylamine is most preferable.

The content of the thickener may be determined so that the consistency (i.e., worked penetration) of the resultant composition according to the invention may be typically 250 to 450, preferably 280 to 415. The aliphatic diurea thickener may preferably be contained in an amount of 0.01 to 5 mass %, more preferably 0.1 to 3 mass %, based on the total mass of the grease composition of the invention.

[(c) Magnetic Particles]

The kind of magnetic particles used in the invention is not particularly limited so long as the particles are provided with magnetic properties. For example, iron and iron compounds such as iron oxide, iron carbide, iron nitride, metal-containing ferroalloy, iron carbonyl and the like; and low-carbon steel, chromium dioxide, nickel, cobalt, gadolinium, gadolinium organic derivatives and the like may be used. One kind of magnetic particles may be used alone, or two or more kinds may be used in combination. Of the above-mentioned magnetic particles, iron particles and iron compound particles are preferable, iron particles and iron carbonyl particles are more preferable, and iron particles are most preferable.

In the invention, commercially available magnetic particles may be used. For example, it is possible to use commercially available magnetic particles from International Specialty Products Inc., under the trade name of CIP. As the magnetic particles, ferromagnetic particles are still more preferable.

The magnetic particles may preferably have a number-average particle diameter of 0.1 to 10 μm, more preferably 1 to 10 μm, and most preferably 5 to 10 μm. In this case, desired magneto-rheological properties can be obtained. In the present invention, the number-average particle diameter of the magnetic particles can be determined by the conventional method, for example, by determining the size of magnetic particles from the electron microscope images. When the magnetic particles are not spherical, the average of the longer diameter and the shorter diameter of each particle is taken, from which the number-average particle diameter is calculated.

In the composition of the invention, the content of the magnetic particles may be within the range of 45 to 95% by mass, preferably 45 to 90% by mass, and more preferably 65 to 90% by mass.

[Antioxidant]

The composition of the invention may further comprise an antioxidant. In consideration of the antioxidant effect, one kind of antioxidant may be used alone or two or more antioxidants may be used in combination. The antioxidants include amine type antioxidants, phenol type antioxidants and quinoline type antioxidants. The representative examples of the amine type antioxidants include α-naphthylamine, phenyl α-naphthylamine, alkylphenyl α-naphthylamine, alkyldiphenylamine and the like; examples of the phenol type antioxidants include hindered phenols such as 2,6-di-tert-butyl-p-cresol, pentaerythrityltetrakis[3-(3,5-di-t-butyl-4-hydroxyphenyl)-propionate], octadecyl-3-(3,5-di-t-butyl-4-hydroxyphenyl)propionate and the like; and examples of the quinoline type antioxidants include 2,2,4-trimethyl-1,2-dihydroquinoline polymer and the like.

Of the above examples amine type antioxidants are preferable, and in particular, alkyldiphenylamine and α-naphthylamine are preferable.

From the viewpoints of the antioxidant effect and the cost, the antioxidant may be contained in an amount of 0.1 to 5% by mass, preferably 0.5 to 4% by mass, and more preferably 1 to 3% by mass, based on the total mass of the composition according to the invention.

[Optional Components]

The composition of the invention may further comprise a dispersant, a detergent dispersant, a corrosion inhibitor, an anti-foam, a rust inhibitor, a load carrying additive and the like, as required. Those components may be added in an amount of about 0.02 to 3% by mass, preferably 0.075 to 1.5% by mass.

Based on the total mass of the composition, the preferable magneto-rheological grease composition according to the invention comprises;

(a) a base oil in an amount of 3 to 50% by mass, preferably 5 to 25% by mass, more preferably 10 to 30% by mass, and most preferably 10 to 25% by mass, (b) a thickener in an amount of 0.1 to 3% by mass, (c) magnetic particles selected from the group consisting of iron and iron compounds, in an amount of 45 to 95% by mass, preferably 45 to 90% by mass, and more preferably 65 to 90% by mass, and (d) an amine type antioxidant in an amount of 1 to 3% by mass.

In the most preferable magneto-rheological grease composition according to the above-mentioned preferable embodiment, (a) the base oil comprises 100% of an alkyl diphenyl ether oil, (b) the aliphatic diurea thickener is a compound represented by the above-mentioned formula (I) where $R^1$ and $R^{1'}$ are a straight-chain alkyl group having 8 carbon atoms, (c) the magnetic particles are ferromagnetic particles, and (d) the amine type antioxidant is an alkyldiphenylamine, which is contained in an amount of 1 to 3% by mass.

EXAMPLES

1. Preparation Methods of Grease Compositions

Examples 1 to 6

(1) In 50 parts of the base oil heated to 70 to 80° C., 4,4'-diphenylmethane diisocyanate was dispersed to prepare (A).

(2) Apart from the step (1), the aliphatic amine was dissolved in 50 parts of the base oil heated to 70 to 80° C. to prepare (B).

(3) After addition of (B) to (A), the resultant mixture was sufficiently stirred and heated to a temperature from 160 to 180° C. Then, the mixture was cooled, and the antioxidant was added to the mixture at a temperature of 80° C. or less. The obtained mixture was further cooled to room temperature, and kneaded by passing through a three-roll mill twice, to obtain a grease composition (C).

(4) After the addition of a predetermined amount of magnetic particles to the above-mentioned (C), the mixture was allowed to pass through the three-roll mill twice to obtain a magneto-rheological grease composition.

Comparative Example 1

Lithium 12-hydroxystearate (Li(12OH)St) was mixed and dissolved into the base oil by application of heat. The resultant mixture was cooled to obtain a base grease. The predetermined amounts of antioxidant and magnetic particles were mixed with the base oil, and the mixture was added to the base grease. The obtained mixture was sufficiently stirred and kneaded using a three-roll mill to obtain a grease composition.

Comparative Examples 2 to 4

Grease compositions were obtained by decreasing the amount of magnetic particles in Comparative Example 2; by adding a paraffinic oil and a naphthenic oil to the ether oil to form a base oil in Comparative Example 3, and by using a base oil not containing an ether oil to form a base oil in Comparative Example 4.

The magneto-rheological grease compositions of Examples 1 to 6 and Comparative Examples 1 to 4 showed a worked penetration ranging from 280 to 415 when measured in accordance with JIS K 2220.

(a) Base Oil

Alkyldiphenyl ether oil: LB-100 (trade name) made by MORESCO Corporation, having a kinetic viscosity at 40° C. of 100 $mm^2/s$.

Ester oil: KL-279 (trade name) made by Kao Corporation, having a kinetic viscosity at 40° C. of 30 $mm^2/s$.

Paraffinic oil: having a kinetic viscosity at 40° C. of 100 $mm^2/s$.

Naphthenic oil: having a kinetic viscosity at 40° C. of 170 $mm^2/s$.

Synthetic hydrocarbon oil: Poly α-olefin having a kinetic viscosity at 40° C. of 412 $mm^2/s$.

In the above, the kinetic viscosity at 40° C. was determined in accordance with JIS K 2220 23.

(c) Magnetic Particles

Ferromagnetic particles: CIP (trade name), made by International Specialty Products Inc. (average particle diameter: 5 to 12 μm)

(d) Antioxidant

Alkyldiphenylamine

2. Evaluation Test Methods (1) Magnetic Properties (kPa)

A coaxial-cylinder rotational viscometer having therein a coil capable of creating a magnetic field was used to determine the magnetic properties. In Tables 1 and 2, the magnetic properties were expressed by the shearing stress at the magnetic flux density T (tesla) of 0.5 and 0.4.

oo: shearing stress of 30 kPa or more o: shearing stress of 20 kPa or more and less than 30 kPa x: shearing stress of less than 20 kPa (2) Dispersion Stability Each magneto-rheological grease composition (10 ml) was charged into a 10-ml measuring cylinder, and allowed to stand at room temperature. After one month, the amount of an oil layer formed on the surface was measured to calculate the percentage by volume (vol %) of the oil layer assuming that the amount of grease (10 ml) filled into the measuring cylinder was regarded as 100.

oo: less than 3.0 o: 3.0 or more and less than 5.0 x: 5.0 or more (3) Thermal Stability

About 5 g of magneto-rheological grease composition was weighed on a glass petri dish with a diameter of 70 mm, and spread over the bottom surface of the dish as uniformly as possible. The above-mentioned petri dish was allowed to stand in an air circulation type thermostatic chamber of 150° C. for 24 hours. The petri dish was taken out 24 hours later, and cooled to room temperature and weighed. The difference in the weight before and after standing the petri dish in the thermostatic chamber was calculated to obtain the evaporation loss.

oo: less than 1.0% o: 1.0% or more and less than 2.0% x: 2.0% or more

TABLE 1

| | | Example No. | | | | | |
|---|---|---|---|---|---|---|---|
| | | 1 | 2 | 3 | 4 | 5 | 6 |
| | | Grease/Fluid | | | | | |
| Class | Composition (mass %) | Magneto-rheological greases | | | | | |
| Grease | Thickener | | | | | | |
| Composition | Octylamine diurea | 0.5 | | | 1.7 | 1.7 | 3.0 |
| | Laurylamine diurea | | 0.7 | | | | |
| | Stearylamine diurea | | | 0.9 | | | |
| | Li(12OH)St | | | | | | |
| | Base oil | | | | | | |
| | Alkyldiphenyl ether oil | 12.5 | 12.3 | 12.1 | 12.8 | 11.3 | 25.0 |
| | Ester oil | | | | 8.5 | | |
| | Paraffinic mineral oil | | | | | 5.0 | |
| | Naphthenic mineral oil | | | | | 5.0 | |
| | Synthetic hydrocarbon oil | | | | | | |

TABLE 1-continued

| Class | Composition (mass %) | Example No. 1 | 2 | 3 | 4 | 5 | 6 |
|---|---|---|---|---|---|---|---|
| | | Grease/Fluid | | | | | |
| | | Magneto-rheological greases | | | | | |
| | Antioxidant | 2.0 | 2.0 | 2.0 | 2.0 | 2.0 | 2.0 |
| | Ferromagnetic particles | 85.0 | 85.0 | 85.0 | 75.0 | 75.0 | 70.0 |
| Results of Evaluation Tests | Magnetic properties | oo | oo | oo | o | o | o |
| | Shear stress (kPa at 0.4T) | 30 | 32 | 33 | 25 | 25 | 23 |
| | | oo | oo | oo | oo | oo | o |
| | Shear stress (kPa at 0.5T) | 35 | 36 | 38 | 30 | 30 | 25 |
| | Dispersion stability (1 month) | oo | oo | oo | oo | oo | oo |
| | Oil layer (vol. %) | 1.0 | 1.5 | 1.5 | 1.0 | 1.0 | 1.0 |
| | Thermal stability (% by mass) | oo | oo | oo | oo | o | oo |
| | Evaporation loss | 0.6 | 0.7 | 0.8 | 0.6 | 1.0 | 0.5 |

TABLE 2

| Class | Composition (mass %) | Comparative Example No. 1 | 2 | 3 | 4 | 5 |
|---|---|---|---|---|---|---|
| | | Grease/Fluid | | | | |
| | | Magneto-rheological greases | | | | Magneto-rheological fluid |
| Grease Composition | Thickener | | | | | |
| | Octylamine diurea | | 0.5 | 1.7 | 1.7 | (*) Commercially available product |
| | Laurylamine diurea | | | | | |
| | Stearylamine diurea | | | | | |
| | Li(12OH)St | 1.2 | | | | |
| | Base oil | | | | | |
| | Alkyldiphenyl ether oil | 21.8 | 57.5 | 5.3 | | |
| | Ester oil | | | | 8.5 | |
| | Paraffinic mineral oil | | | 8.0 | 6.4 | |
| | Naphthenic mineral oil | | | 8.0 | 6.4 | |
| | Synthetic hydrocarbon oil | | | | | |
| | Antioxidant | 2.0 | 2.0 | 2.0 | 2.0 | |
| | Ferromagnetic particles | 75.0 | 40.0 | 75.0 | 75.0 | |
| Results of Evaluation Tests | Magnetic properties | o | x | o | o | o |
| | Shear stress (kPa at 0.4T) | 25 | 8 | 25 | 25 | 25 |
| | | oo | x | oo | oo | oo |
| | Shear stress (kPa at 0.5T) | 30 | 10 | 30 | 30 | 30 |
| | Dispersion stability (1 month) | oo | oo | oo | oo | x |
| | Oil layer (vol. %) | 1.5 | 1.0 | 1.0 | 1.0 | 15.0 |
| | Thermal stability (% by mass) | x | oo | x | x | x |
| | Evaporation loss | 2.4 | 0.6 | 2.2 | 2.6 | 2.8 |

(*) Commercially available product: containing 75% by mass of ferromagnetic particles.

INDUSTRIAL APPLICABILITY

The magneto-rheological grease composition of the invention has the effect of controlling the movement of a repeatedly moving part, and absorbing and repulsing the impact. The current use for the magneto-rheological grease composition is therefore found in dampers for cars, suspensions, joints of nursing-care robots, antiseismic devices, equipment for rehabilitation, safety interlock mechanisms and the like.

The magneto-rheological grease composition of the invention can absorb any impact generated between the phases, i.e., gases, a gas and a liquid, a gas and a solid, liquids, a liquid and a solid, solids and the like, so that a wide range of application will be expected.

The invention claimed is:

1. A magneto-rheological grease composition comprising:

(a) a base oil comprising at least 30% by mass of an ether type synthetic oil having a kinetic viscosity at 40° C. of 60 to 140 $mm^2/s$;

(b) an aliphatic diurea thickener; and (c) magnetic particles in an amount of 45 to 95% by mass based on the total mass of the composition, wherein the aliphatic diurea thickener is represented by formula (1):

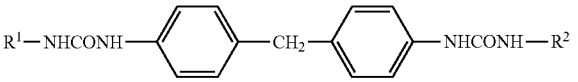

(1)

wherein $R^1$ and $R^2$ are a straight-chain or branched alkyl group having 6 to 20 carbon atoms, and wherein $R^1$ and $R^2$ are the same.

2. The magneto-rheological grease composition of claim 1, wherein the ether type synthetic oil is an alkyldiphenyl ether oil.

3. The magneto-rheological grease composition of claim 1, wherein the magnetic particles are particles of at least one selected from the group consisting of iron and iron compounds.

4. The magneto-rheological grease composition of claim 1, wherein the magnetic particles have an average particle diameter of 0.1 to 10 μm.

5. The magneto-rheological grease composition of claim 1, wherein the magnetic particles are ferromagnetic particles.

6. The magneto-rheological grease composition of claim 5, wherein the ferromagnetic particles are iron particles.

7. The magneto-rheological grease composition of claim 1, further comprising an antioxidant (d).

8. The magneto-rheological grease composition of claim 7, wherein the antioxidant is an amine type antioxidant.

9. The magneto-rheological grease composition of claim 8, wherein the amine type antioxidant is alkyldiphenylamine, α-naphthylamine, or a mixture thereof.

10. The magneto-rheological grease composition of claim 1, having a worked penetration of 250 to 450.

11. An apparatus where the grease composition of claim 1 is enclosed in a repeatedly moving part.

* * * * *